US010209657B2

(12) United States Patent
Tomino

(10) Patent No.: US 10,209,657 B2
(45) Date of Patent: Feb. 19, 2019

(54) IMAGE FORMING APPARATUS, IMAGE FORMING SYSTEM, AND NOTIFICATION METHOD

(71) Applicant: Konica Minolta, Inc., Chiyoda-ku, Tokyo (JP)

(72) Inventor: Toshiaki Tomino, Hachioji (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 15/461,171

(22) Filed: Mar. 16, 2017

(65) Prior Publication Data

US 2017/0315487 A1 Nov. 2, 2017

(30) Foreign Application Priority Data

Apr. 28, 2016 (JP) ..... 2016-091520

(51) Int. Cl.
*G03G 15/00* (2006.01)
*G03G 15/08* (2006.01)

(52) U.S. Cl.
CPC ..... *G03G 15/5016* (2013.01); *G03G 15/0844* (2013.01); *G03G 15/556* (2013.01); *G03G 15/652* (2013.01); *G03G 2215/0005* (2013.01); *G03G 2215/00029* (2013.01); *G03G 2215/00033* (2013.01); *G03G 2215/00037* (2013.01); *G03G 2215/00755* (2013.01)

(58) Field of Classification Search
CPC ..... G03G 15/5016; G03G 2215/00029; G03G 2215/00033; G03G 2215/00037; G03G 2215/0005; G03G 2215/00755
See application file for complete search history.

(56) References Cited

U.S. PATENT DOCUMENTS

2003/0049054 A1* 3/2003 Ozawa ..... G03G 15/0808 399/272
2010/0150583 A1* 6/2010 Hitaka ..... G03G 15/553 399/28
2014/0241739 A1* 8/2014 Takeuchi ..... G03G 15/556 399/27
2016/0170357 A1* 6/2016 Saito ..... G03G 15/0844 399/27
2017/0277105 A1* 9/2017 Tomino ..... G03G 15/6529

FOREIGN PATENT DOCUMENTS

JP 574165 B2 7/2015

* cited by examiner

*Primary Examiner* — Ryan D Walsh
(74) *Attorney, Agent, or Firm* — Squire Patton Boggs (US) LLP

(57) ABSTRACT

An image forming apparatus includes: an image forming portion that includes a developing portion configured to supply toner to an image bearing member bearing an electrostatic latent image formed thereon to develop the electrostatic latent image as a toner image, and is configured to form a toner image on a long paper sheet; a notification portion configured to notify a user about information; and a control portion configured to calculate, in accordance with coverage of a toner image that is a target of image formation, a toner image formation distance with which successive image formation is possible without forcibly discharging degraded toner from the developing portion, and to control the notification portion to notify the calculated toner image formation distance as a first toner image formation distance.

14 Claims, 8 Drawing Sheets

IMAGE FORMING APPARATUS, IMAGE FORMING SYSTEM, AND NOTIFICATION METHOD

The entire disclosure of Japanese Patent Application No. 2016-091520 filed on Apr. 28, 2016 including description, claims, drawings, and abstract are incorporated herein by reference in its entirety.

BACKGROUND OF THE INVENTION

Field of the Invention

The present invention relates to an image forming apparatus, an image forming system, and a notification method.

Description of the Related Art

Generally, an image forming apparatus (for example, a printer, a copier, and a facsimile machine) utilizing an electrophotographic process technique forms an electrostatic latent image by irradiating (exposing) an electrified photosensitive drum (image bearing member) with laser light based on image data. Then, the image forming apparatus visualizes the electrostatic latent image as a toner image by supplying toner from a developing device to the photosensitive drum bearing the electrostatic latent image formed thereon. Further, the image forming apparatus forms the toner image on a paper sheet by transferring the toner image directly or indirectly onto the paper sheet and then fixing the toner image by heating and pressurizing the paper sheet at a fixing nip.

In the case where, for example, toner images of low coverage are successively printed, toner in the developing device stays in the developing device for a long period of time without being used for image formation, and thus the charge of the toner is lowered and the toner is degraded. Since image defects such as scattering of toner occur when degraded toner is used for image formation, it is desirable that the degraded toner is discharged from the developing device quickly. Generally, in the case of an image forming apparatus that forms an image on a cut paper sheet, degraded toner is discharged from the developing device by discharging a toner belt, which is a predetermined belt-shaped pattern, onto an intermediate transfer belt (image bearing member) at a timing in which image formation is not performed such as an interval of sheet feeding. However, in the case of an image forming apparatus that performs image formation on a continuous paper sheet, a region large enough to form a toner belt cannot be provided between regions where images are formed, and thus degraded toner cannot be discharged from the developing device as the image forming apparatus for a cut paper sheet does.

FIG. 1 illustrates a long paper sheet on which images are formed in a conventional example. For example, according to a technique described in JP 5741656 B, in the case where a plurality of toner images G1 are printed on a long paper sheet P (continuous paper sheet) as illustrated in FIG. 1, degraded toner is discharged by performing control to detect the overall coverage and form toner belts G2 in side regions of the long paper sheet P such that the coverage becomes equal to or larger than a predetermined threshold value (for example, 3%).

However, the technique described in JP 5741656 B has a problem that, in the case where the coverage is equal to or larger than the threshold value, the toner belts G2 are discharged onto the long paper sheet P even if the ratio of degraded toner in the developing device is relatively small, and thus a region for printing becomes smaller and the long paper sheet P is consumed wastefully.

SUMMARY OF THE INVENTION

An object of the present invention is to provide an image forming apparatus, an image forming system, and a notification method that are capable of suppressing wasteful consumption of a long paper sheet in printing on the long paper sheet.

To achieve the abovementioned object, according to an aspect, an image forming apparatus reflecting one aspect of the present invention comprises:

an image forming portion that includes a developing portion configured to supply toner to an image bearing member bearing an electrostatic latent image formed thereon to develop the electrostatic latent image as a toner image, and is configured to form a toner image on a long paper sheet;

a notification portion configured to notify a user about information; and a control portion configured to calculate, in accordance with coverage of a toner image that is a target of image formation, a toner image formation distance with which successive image formation is possible without forcibly discharging degraded toner from the developing portion, and to control the notification portion to notify the calculated toner image formation distance as a first toner image formation distance.

To achieve the abovementioned object, according to an aspect, an image forming system constituted by a plurality of units including an image forming apparatus, reflecting one aspect of the present invention comprises:

an image forming portion that includes a developing portion configured to supply toner to an image bearing member bearing an electrostatic latent image formed thereon to develop the electrostatic latent image as a toner image, and is configured to form a toner image on a long paper sheet;

a notification portion configured to notify a user about information; and a control portion configured to calculate, in accordance with coverage of a toner image that is a target of image formation, a toner image formation distance with which successive image formation is possible without forcibly discharging degraded toner from the developing portion, and to control the notification portion to notify the calculated toner image formation distance as a first toner image formation distance.

To achieve the abovementioned object, according to an aspect, there is provided a notification method of an image forming apparatus including an image forming portion that includes a developing portion configured to supply toner to an image bearing member bearing an electrostatic latent image formed thereon to develop the electrostatic latent image as a toner image, and is configured to form a toner image on a long paper sheet, and the notification method reflecting one aspect of the present invention comprises:

calculating, in accordance with coverage of a toner image that is a target of image formation, a toner image formation distance with which successive image formation is possible without forcibly discharging degraded toner from the developing portion; and notifying a user about the calculated toner image formation distance as a first toner image formation distance.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 2:
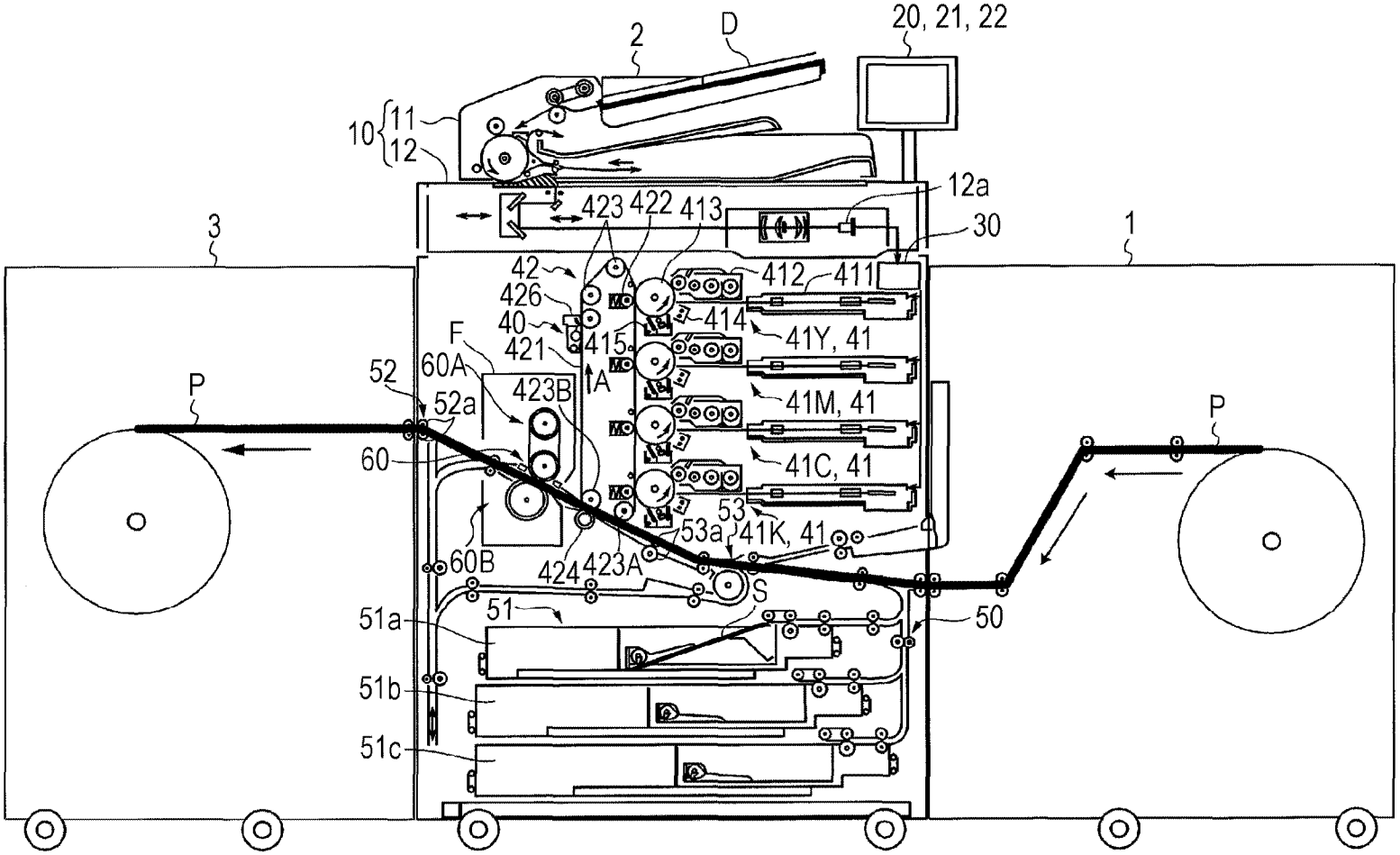
FIG. 2 schematically illustrates an overall configuration of an image forming system according to an embodiment.
Figure 3:
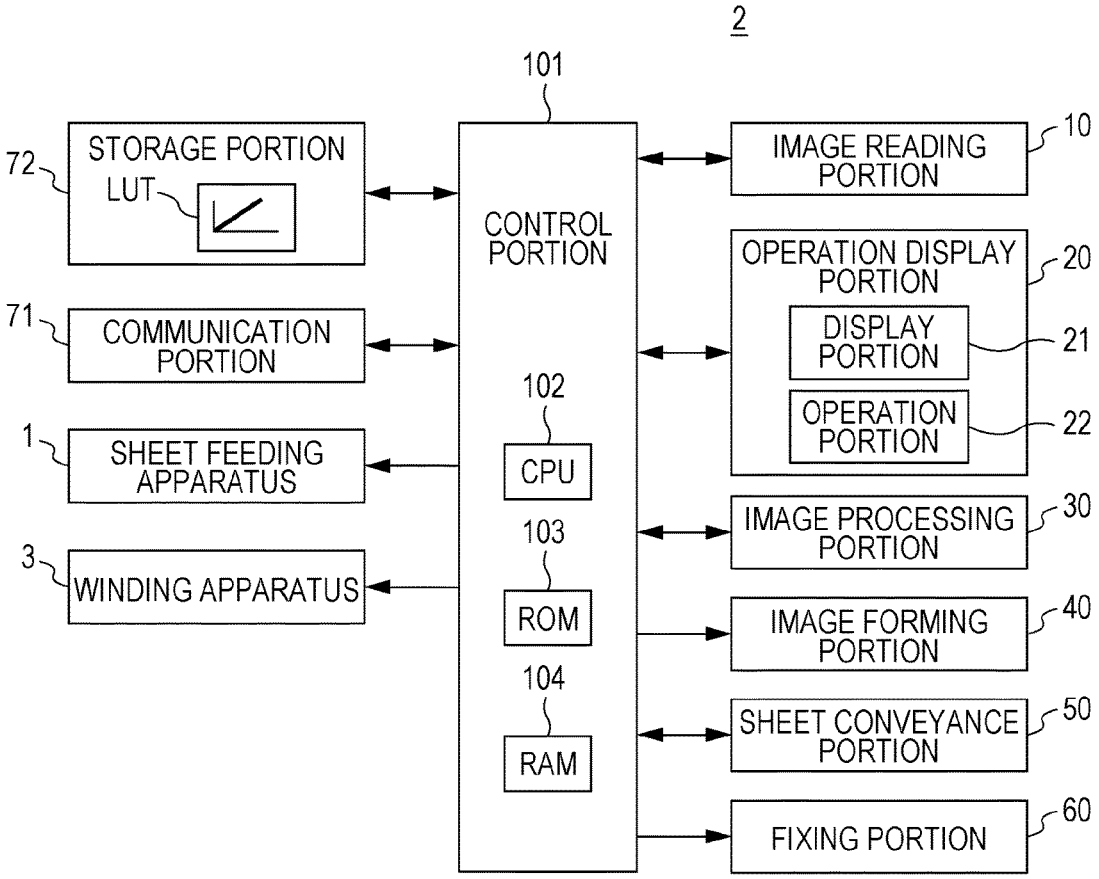
FIG. 3 illustrates a main part of a control system of an image forming apparatus provided for the image forming system according to the embodiment.

Hereinafter, an embodiment of the present invention will be described in detail with reference to the drawings. However, the scope of the invention is not limited to the illustrated examples. FIG. 2 schematically illustrates an overall configuration of an image forming system 100 according to the present embodiment. FIG. 3 illustrates a main part of a control system of the image forming apparatus 2 provided for the image forming system 100 according to the present embodiment.

The image forming system 100 is a system that uses a long paper sheet P illustrated by a thick line in FIG. 2 or a paper sheet S (not a long paper sheet) as a recording medium and forms an image on the long paper sheet P or the paper sheet S.

The long paper sheet P is a long paper sheet that has a length, for example, exceeding the width of the body of the image forming apparatus 2 in a conveyance direction thereof, and examples thereof include roll paper sheets and continuous paper sheets.

As illustrated in FIG. 2, the image forming system 100 is constituted by a sheet feeding apparatus 1, the image forming apparatus 2, and a winding apparatus 3 interconnected in this order from the upstream side along the conveyance direction of the long paper sheet P. The sheet feeding apparatus 1 and the winding apparatus 3 are used in the case of forming an image on the long paper sheet P.

The sheet feeding apparatus 1 is an apparatus that feeds the long paper sheet P to the image forming apparatus 2. In the body of the sheet feeding apparatus 1, the long paper sheet P is wound up around a support shaft into a roll shape and kept in a rotatable state as illustrated in FIG. 2. The sheet feeding apparatus 1 conveys the long paper sheet P wound up around the support shaft to the image forming apparatus 2 at a constant speed via a plurality of pairs of conveyance rollers, for example, sending rollers and feeding rollers. The feeding operation of the sheet feeding apparatus 1 is controlled by a control portion 101 provided in the image forming apparatus 2.

The image forming apparatus 2 is a color image forming apparatus of an intermediate transfer type utilizing an electrophotographic process technique. That is, the image forming apparatus 2 transfers toner images of respective colors of yellow (Y), magenta (M), cyan (C), and black (K) formed on photosensitive drums 413 onto an intermediate transfer belt 421 through primary transfer such that the toner images of four colors are superposed on one another on the intermediate transfer belt 421. Then, the image forming apparatus 2 forms an image by transferring the superposed toner image onto the long paper sheet P fed from the sheet feeding apparatus 1 or a paper sheet S sent out from one of sheet feeding tray units 51*a* to 51*c* through secondary transfer.

In addition, the image forming apparatus 2 employs a tandem system in which the photosensitive drums 413 corresponding to the four colors of YMCK are arranged in series in the moving direction of the intermediate transfer belt 421 and toner images of the respective colors are sequentially transferred onto the intermediate transfer belt 421 through one operation.

As illustrated in FIG. 3, the image forming apparatus 2 includes an image reading portion 10, an operation display portion 20, an image processing portion 30, an image forming portion 40, a sheet conveyance portion 50, a fixing portion 60, and the control portion 101.

The control portion 101 includes, for example, a central processing unit (CPU) 102, a read only memory (ROM) 103, a random access memory (RAM) 104. The CPU 102 reads a program corresponding to the content of processing from the ROM 103, loads the read program on the RAM 104, and dominantly controls the operation of each block and the like of the image forming apparatus 2 in cooperation with the loaded program. At this time, various data stored on a storage portion 72 is referred to. The storage portion 72 is constituted by, for example, a nonvolatile semiconductor memory (so-called flash memory) and a hard disk drive.

The control portion 101 communicates various data, via a communication portion 71, with an external apparatus (for example, a personal computer) connected to a communication network such as a local area network (LAN) or a wide area network (WAN). The control portion 101 receives, for example, image data (input image data) transmitted from the external apparatus, and causes the image forming apparatus 2 to form an image on the long paper sheet P or the paper sheet S on the basis of this image data. The communication portion 71 is constituted by, for example, a communication control card such as a LAN card.

As illustrated in FIG. 2, the image reading portion 10 includes an automatic document feeding device 11 called as an automatic document feeder (ADF), a document image scanning device (scanner) 12, and so forth.

The automatic document feeding device 11 sends out a document D placed on a document tray to the document image scanning device 12 by conveying the document D with a conveyance mechanism. The automatic document feeding device 11 enables successively reading images of a large number of documents D placed on the document tray (including images formed on both surfaces of a document D) in one time.

The document image scanning device 12 optically scans a document conveyed onto contact glass from the automatic document feeding device 11 or a document put on the contact glass, focuses light reflected from the document on a light receiving plane of a charge coupled device (CCD) sensor 12*a*, and thereby reads a document image. The image reading portion 10 generates input image data on the basis of the result of reading by the document image scanning device 12. The input image data is subjected to predetermined image processing by the image processing portion 30.

As illustrated in FIG. 3, the operation display portion 20 is constituted by, for example, a liquid crystal display (LCD) equipped with a touch panel, and functions as a display portion 21 and an operation portion 22. The display portion 21 displays various operation screens, a state of an image, an operation state of each function, information related to printing, and the like in accordance with a display control signal input from the control portion 101. The operation portion 22 includes various operation keys such as a numeric keypad and a start key, receives various input operations by a user, and outputs an operation signal to the control portion 101. The display portion 21 corresponds to a "notification portion" according to the present invention.

The image processing portion 30 includes a circuit or the like that performs digital image processing on the input image data in accordance with initial settings or user settings. For example, the image processing portion 30 performs gradation correction on the basis of gradation correction data (a gradation correction table) under control of the control portion 101. In addition, the image processing portion 30 performs various correction processing such as color correction and shading correction, compression processing, and so forth on the input image data in addition to the gradation correction. The image forming portion 40 is controlled on the basis of the image data that has undergone these processes.

As illustrated in FIG. 2, the image forming portion 40 includes image forming units 41Y, 41M, 41C, and 41K, an intermediate transfer unit 42, and so forth. The image forming units 41Y, 41M, 41C, and 41K form images with respective color toners of a Y component, an M component, a C component, and a K component on the basis of the input image data.

The image forming units 41Y, 41M, 41C, and 41K respectively corresponding to the Y component, the M component, the C component, and the K component are the same in configuration. For convenience of illustration and description, common constituents are denoted with the same reference letters. In the case where each constituent is distinguished, the distinction thereof is represented by adding Y, M, C, or K to the reference letters. In FIG. 2, reference letters are given only to constituents of the image forming unit 41Y corresponding to the Y component, and reference letters for the constituents of the other image forming units 41M, 41C, and 41K are omitted.

The image forming unit 41 includes an exposure device 411, a developing device 412, a photosensitive drum 413, a charging device 414, a drum cleaning device 415, and so forth. The developing device 412 corresponds to a "developing portion" according to the present invention.

The photosensitive drum 413 is constituted by, for example, an organic photosensitive body including a photosensitive layer formed of a resin containing an organic photoconductor on an outer circumferential surface of a drum-shaped metal base body.

The control portion 101 rotates the photosensitive drum 413 at a constant circumferential speed by controlling a driving current supplied to a driving motor (illustration omitted) configured to drive the photosensitive drum 413.

The charging device 414 is, for example, an electrifying charger, and uniformly charges the surface of the photosensitive drum 413 that is photoconductive to a negative polarity by causing a corona discharge.

The exposure device 411 is constituted by, for example, a semiconductor laser, and irradiates the photosensitive drum 413 with laser light corresponding to an image of a corresponding color component. As a result of this, in an image region irradiated with the laser light in the surface of the photosensitive drum 413, an electrostatic latent image of the corresponding color component is formed due to a potential difference from a background region.

The developing device 412 is a developing device employing a two-component reversal development system, and forms a toner image by attaching toner of a corresponding color component to the surface of the photosensitive drum 413 to visualize the electrostatic latent image.

A developing bias is applied to the developing device 412. The developing bias is, for example, a direct-current developing bias having the same polarity as the charging polarity of the charging device 414, or a developing bias in which a direct-current voltage having the same polarity as the charging polarity of the charging device 414 is superposed on an alternating-current voltage. As a result of this, reversal development in which toner is attached to the electrostatic latent image formed by the exposure device 411 is performed.

The drum cleaning device 415 abuts the surface of the photosensitive drum 413, includes a drum cleaning blade having a flat plate shape and formed of an elastic material and the like, and removes toner remaining on the surface of the photosensitive drum 413 without being transferred onto the intermediate transfer belt 421.

The intermediate transfer unit 42 includes the intermediate transfer belt 421, primary transfer rollers 422, a plurality of support rollers 423, a secondary transfer roller 424, a belt cleaning device 426, and so forth. The intermediate transfer belt 421 corresponds to an "image bearing member" according to the present invention.

The intermediate transfer belt 421 is configured as an endless belt, and is looped over the plurality of support rollers 423. At least one of the plurality of support rollers 423 is configured as a driving roller, and the others are configured as driven rollers. For example, a roller 423A disposed downstream of a primary transfer roller 422 for the K component in the moving direction of the intermediate transfer belt 421 is preferably a driving roller. This helps keeping the moving speed of the intermediate transfer belt 421 at a primary transfer portion constant. The intermediate transfer belt 421 moves in an arrow A direction at a constant speed due to the rotation of the driving roller 423A.

The intermediate transfer belt 421 is a conductive and elastic belt, and includes a high-resistance layer on the surface thereof. The intermediate transfer belt 421 is driven to rotate in accordance with a control signal from the control portion 101.

The primary transfer rollers 422 are disposed on the inner circumferential surface side of the intermediate transfer belt 421 so as to oppose the photosensitive drums 413 of respective colors. The primary transfer rollers 422 are in pressure contact with the photosensitive drums 413 with the intermediate transfer belt 421 interposed therebetween, and thus primary transfer nips for transferring toner images from the photosensitive drums 413 onto the intermediate transfer belt 421 are formed.

The secondary transfer roller 424 is disposed on the outer circumferential surface side of the intermediate transfer belt 421 so as to oppose a backup roller 423B disposed downstream of the driving roller 423A in the moving direction of the intermediate transfer belt 421. The secondary transfer roller 424 is in pressure contact with the backup roller 423B with the intermediate transfer belt 421 interposed therebetween, and thus a secondary transfer nip for transferring a toner image from the intermediate transfer belt 421 onto the long paper sheet P or the paper sheet S is formed.

When the intermediate transfer belt 421 passes through the primary transfer nips, the toner images on the photosensitive drums 413 are sequentially transferred onto the intermediate transfer belt 421 through primary transfer so as to be superposed on one another. More specifically, the toner images are electrostatically transferred onto the intermediate transfer belt 421 by applying a primary transfer bias to the primary transfer rollers 422 and imparting charges of a polarity opposite to the toner to the back side, that is, the side in contact with the primary transfer rollers 422, of the intermediate transfer belt 421.

Then, when the long paper sheet P or the paper sheet S passes through the secondary transfer nip, the toner image on the intermediate transfer belt 421 is transferred onto the long paper sheet P or the paper sheet S through secondary transfer. More specifically, the toner image is electrostatically transferred onto the long paper sheet P or the paper sheet S by applying a secondary transfer bias to the secondary transfer roller 424 and imparting charges of a polarity opposite to the toner to the back side, that is, the side in contact with the secondary transfer roller 424, of the long paper sheet P or the paper sheet S. The long paper sheet P or the paper sheet S onto which the toner image has been transferred is conveyed toward the fixing portion 60.

The belt cleaning device 426 removes transfer residual toner remaining on the surface of the intermediate transfer belt 421 after second transfer. Alternatively, a so-called belt-type secondary transfer unit in which a secondary transfer belt is looped over a plurality of support rollers including a secondary transfer roller may be employed instead of the secondary transfer roller 424.

The fixing portion 60 includes an upper fixing portion 60A, a lower fixing portion 60B, a heating source, and so forth. The upper fixing portion 60A includes a fixing-surface-side member disposed on the fixing surface side, that is, the side on which the toner image is formed, of the long paper sheet P or the paper sheet S. The lower fixing portion 60B includes a back-surface-side support member disposed on the back surface side, that is, the side on which a surface opposite to the fixing surface is positioned, of the long paper sheet P or the paper sheet S. The back-surface-side support member is in pressure contact with the fixing-surface-side member, and thus a fixing nip in which the long paper sheet P or the paper sheet S is nipped and conveyed is formed.

The fixing portion 60 fixes the toner image onto the long paper sheet P or the paper sheet S by heating and pressurizing the long paper sheet P or the paper sheet S, onto which the toner image has been transferred through secondary transfer and which has been conveyed, in the fixing nip. The fixing portion 60 is disposed as a unit in a fixing device F. The fixing device F may include an air separation unit that separates the long paper sheet P or the paper sheet S from the fixing-surface-side member or the back-surface-side support member by blowing air thereto.

The sheet conveyance portion 50 includes a sheet feeding portion 51, a sheet discharge portion 52, a conveyance path portion 53, and so forth. Three sheet feeding tray units 51*a* to 51*c* constituting the sheet feeding portion 51 accommodate paper sheets S (standard long paper sheets and non-standard long paper sheets) identified on the basis of grammage, size, and the like and divided into preset types. The conveyance path portion 53 includes a plurality of conveyance roller pairs including a registration roller pair 53*a*. A registration roller portion provided with the registration roller pair 53*a* corrects the inclination and displacement of the paper sheet S or the long paper sheet P.

The paper sheets S accommodated in the sheet feeding tray units 51*a* to 51*c* are fed one by one from the topmost part thereof, and conveyed to the image forming portion 40 by the conveyance path portion 53. In the image forming portion 40, the toner image on the intermediate transfer belt 421 is collectively transferred onto one surface of the paper sheet S through secondary transfer, and a fixing process is performed in the fixing portion 60.

In addition, the long paper sheet P fed from the sheet feeding apparatus 1 to the image forming apparatus 2 is conveyed to the image forming portion 40 by the conveyance path portion 53. Then, in the image forming portion 40, the toner image on the intermediate transfer belt 421 is collectively transferred onto one surface of the long paper sheet P through secondary transfer, and a fixing process is performed in the fixing portion 60. The long paper sheet P or the paper sheet S on which an image has been formed is conveyed to the winding apparatus 3 by the sheet discharge portion 52 including a conveyance roller pair (sheet discharge roller pair) 52*a*.

The winding apparatus 3 is an apparatus that winds up the long paper sheet P conveyed from the image forming apparatus 2. In the body of the winding apparatus 3, the long paper sheet P is, for example, wound up around a support shaft and kept in a roll shape. Thus, the winding apparatus 3 winds up the long paper sheet P conveyed from the image forming apparatus 2 around the support shaft at a constant speed via a plurality of conveyance roller pairs (for example, sending rollers and sheet discharge rollers). The winding operation of the winding apparatus 3 is controlled by the control portion 101 provided in the image forming apparatus 2.

In the case where, for example, toner images of low coverage are successively printed, toner in the developing device 412 stays in the developing device 412 for a long period of time without being used for image formation, and thus the charge of the toner is lowered and the toner is degraded. Since image defects such as scattering of toner occur when such degraded toner is used for image formation, it is desirable that the degraded toner is discharged from the developing device 412.

Generally, even in the case where a toner image of low coverage is printed, degraded toner is forcibly discharged from the developing device 412 before or after printing via a discharge sequence if a successive printing distance on the long paper sheet P is below a predetermined threshold value (for example, 300 m). In the discharge sequence, a toner belt is, for example, discharged onto the intermediate transfer belt 421 with the intermediate transfer belt 421 separated from the long paper sheet P. The toner belt discharged onto the intermediate transfer belt 421 is removed from the intermediate transfer belt 421 by, for example, the belt cleaning device 426.

Figure 4:
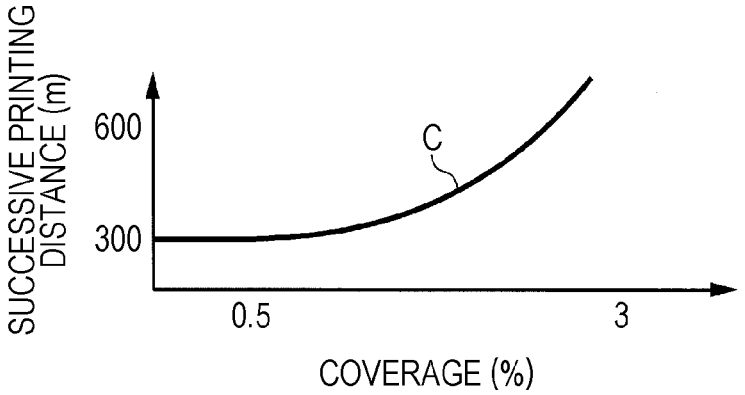
FIG. 4 illustrates predetermined threshold values of a successive printing distance with respect to coverage of toner images.

FIG. 4 illustrates predetermined threshold values of successive printing distance with respect to coverage of toner images. A curve C represents predetermined threshold values of successive printing distance. Generally, and as illustrated in FIG. 4, it is confirmed that the predetermined threshold values of successive printing distance change in accordance with the coverage of printed toner images. More specifically, the curve C representing the predetermined threshold values change such that the larger the coverage of toner images becomes, the longer the successive printing distance becomes. For example, in the case where the coverage of toner images is 0.5%, the predetermined threshold value of successive printing distance is 300 m. In addition, in the case where the coverage of toner images is 3%, the predetermined threshold value of successive printing distance is greater than 600 m.

Figure 1:
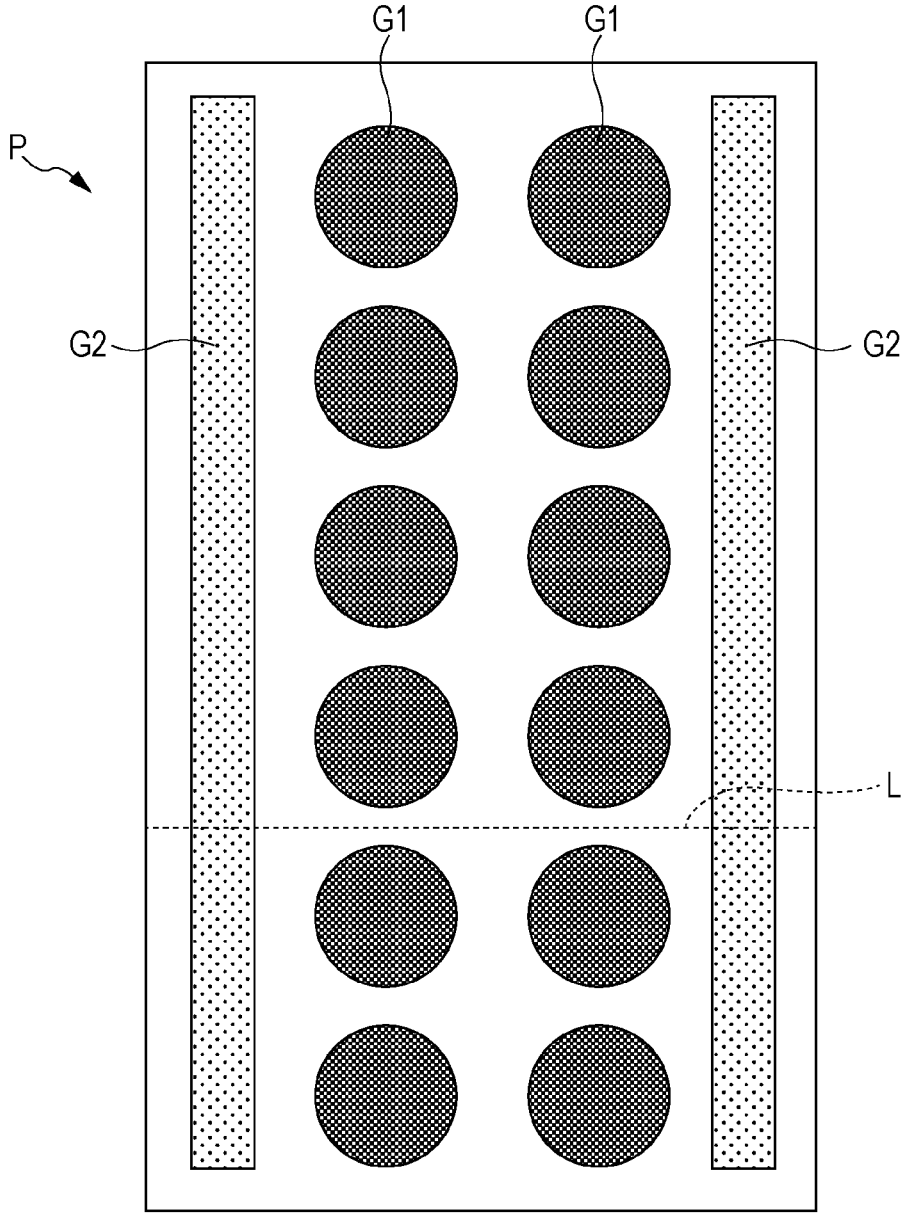
FIG. 1 illustrates a long paper sheet on which images are formed in a conventional example.
Figure 5:
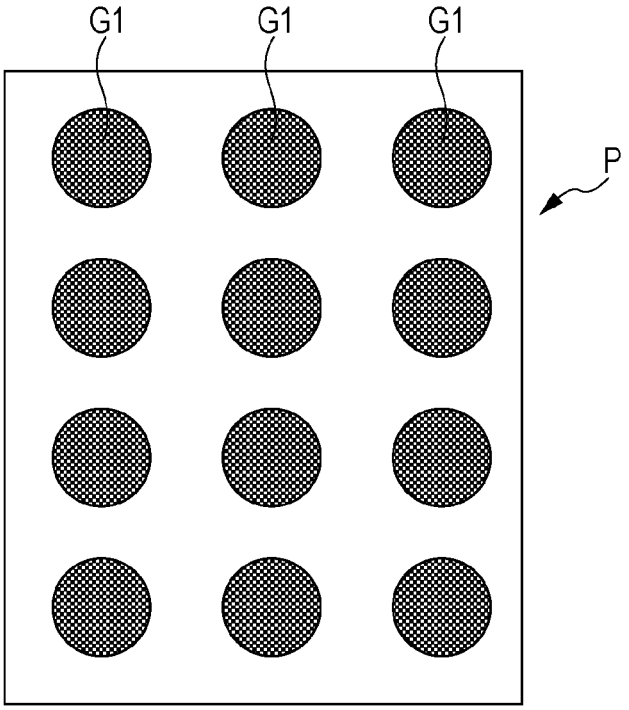
FIG. 5 illustrates a long paper sheet on which images are formed in the embodiment.

Unless the predetermined threshold value of successive printing distance is exceeded, a plurality of toner images G1 can be printed in the whole of a printing region on the long paper sheet P even when the coverage of the toner images G1 is small in the case of printing the plurality of toner images G1 as illustrated in FIG. 5. However, as illustrated in FIG. 1, toner belts G2 are formed in side regions of the long paper sheet P such that the coverage of a plurality of toner images G1 is equal to or more than a predetermined threshold value (for example, 3%) according to a conventional technique (technique described in JP 5741656 B). Therefore, the printing region according to the conventional technique is narrow, and thus it is required to wastefully consume a part below a broken line L, by contrast with the case of FIG. 5.

To address this, in the present embodiment, the control portion 101 calculates, in accordance with the coverage of a toner image that is a target of image formation, the maximum printing distance with which successive image formation can be performed without forcibly discharging degraded toner from the developing device 412, and notifies a user about the maximum printing distance by displaying the maximum printing distance on the display portion 21. According to this, the maximum printing distance corresponding to the coverage of toner image can be notified to the user, and the user can set an output printing distance on the basis of the information of the maximum printing distance. Therefore, the toner belts G2 illustrated in FIG. 1 is no longer required to be discharged onto the long paper sheet P. This enables efficiently using the printing region on the long paper sheet P, and thus suppressing the wasteful consumption of the long paper sheet P. The maximum printing distance corresponds to a "first toner image formation distance" and a "toner image formation distance" according to the present invention. The output printing distance corresponds to a "second toner image formation distance" according to the present invention.

In addition, the printing distances represented by the curve C in FIG. 4 may be set as the maximum printing distance, and the printing distance for each coverage is stored on the storage portion 72 in advance.

The control portion 101 may display a notification instruction prompting the user to change the output printing distance on the display portion 21 in the case where the output printing distance set by the user is longer than the maximum printing distance. According to this, the output printing distance that has been set once can be quickly changed to a distance equal to or shorter than the maximum printing distance with which the long paper sheet P is not wastefully consumed.

In the case where the output printing distance set by the user is longer than the maximum printing distance, the control portion 101 may perform control so as to perform a discharge sequence in which a toner belt is forcibly discharged onto the intermediate transfer belt 421 without forming a toner image on the long paper sheet P during an image formation process. According to this, although the image formation process is performed even in the case where the user does not change the output printing distance, degraded toner is discharged onto parts different from the long paper sheet P by performing the discharge sequence during the image formation process. Therefore, printing control for the printing distance set by the user can be performed without wastefully consuming the long paper sheet P.

In the case where the output printing distance set by the user is longer than the maximum printing distance and the output printing distance is not changed by the user, the control portion 101 may perform control so as to forcibly discharge degraded toner by forming a toner image, that is, a toner belt, in a part of the long paper sheet P. According to this, printing control can be performed without stopping printing in the case where the user desires to perform printing even though the user is notified that the output printing distance is longer than the maximum printing distance.

In the case where the output printing distance set by the user is longer than the maximum printing distance, the control portion 101 may perform control so as to stop performing the image formation process. According to this, resetting of the output printing distance set by the user can be facilitated.

In addition, the control portion 101 may control the display portion 21 so as to display notification prompting the user to select two or more of the control for promoting changing the output printing distance, the control for performing the discharge sequence during the image formation process, the control for forcibly discharging a toner belt onto a part of the long paper sheet P, and the control for stopping performing the image formation process described above. According to this, control according to the demand of the user can be quickly performed.

In addition, the control portion 101 calculates, before the user sets the output printing distance and in accordance with the coverage of the toner image, the maximum printing distance with which successive image formation can be performed. According to this, the user can set the output printing distance after recognizing the maximum printing distance, and thus setting a desired output printing distance can be facilitated.

The control portion 101 performs the discharge sequence in which degraded toner is forcibly discharged from the developing device 412 after finishing the image formation process of the toner image that is the target of image formation. According to this, the inside of the developing device 412 can be refreshed before the next printing job is performed.

Figure 6:
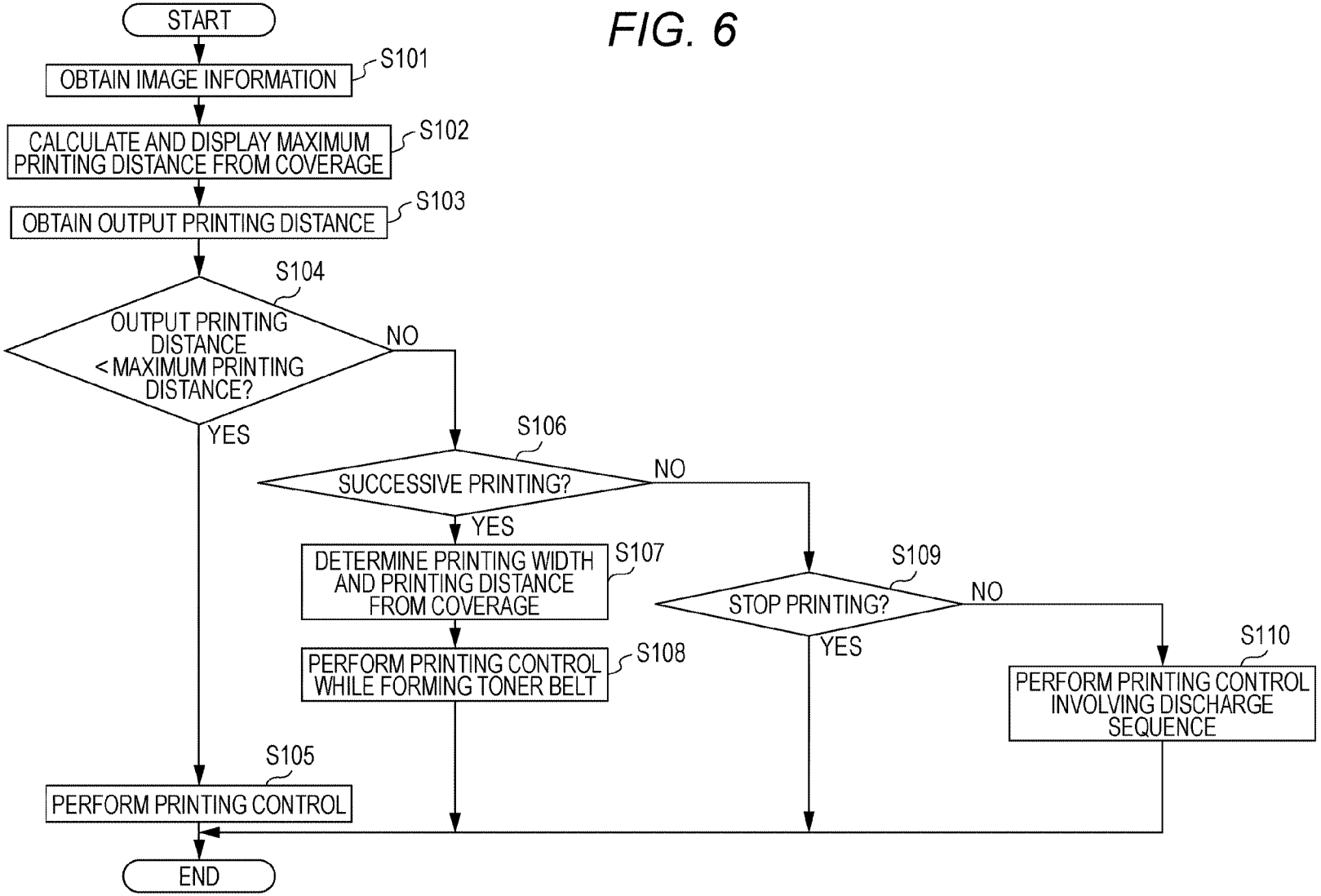
FIG. 6 is a flowchart illustrating an exemplary operation when performing printing control in the image forming apparatus.

Next, an exemplary operation when performing printing control in the image forming apparatus 2 including the control portion 101 described above will be described. FIG. 6 is a flowchart illustrating an exemplary operation when performing printing control in the image forming apparatus 2. The process illustrated in FIG. 6 is performed in the case where, for example, an instruction to perform a printing job is received when the coverage of the toner image in image information is lower than a predetermined rate (3%).

As illustrated in FIG. 6, the control portion 101 obtains image information of the printing job (step S101). Next, the control portion 101 calculates the maximum printing distance with which successive printing can be performed from the coverage of the toner image in the image information, and causes the display portion 21 to display the calculated maximum printing distance (step S102). Next, the control portion 101 causes the display portion 21 to display a screen prompting the user to set the output printing distance, and obtains the output printing distance set by the user (step S103).

Next, the control portion 101 determines whether the output printing distance is shorter than the maximum printing distance (step S104). In the case where it is determined that the output printing distance is shorter than the maximum printing distance (step S104: YES), the control portion 101 performs an image formation process, that is, printing control, without forcibly discharging a toner belt onto the long paper sheet P (step S105), and the control is finished. Meanwhile, in the case where it is determined that the output printing distance is equal to or longer than the maximum printing distance (step S104: NO), the control portion 101 displays, on the display portion 21, a screen prompting the user to select whether to perform printing successively (hereinafter referred to as "successive printing"), and determines whether an instruction to perform successive printing is obtained from the user (step S106).

In the case where it is determined that the instruction to perform successive printing is obtained (step S106: YES), the control portion 101 determines a printing width and a printing distance from the coverage of the toner image (step S107). The printing width is a width of a region in which the toner image is to be formed, and is determined in consideration of the amount of toner belt to be formed on aside region of the long paper sheet P. The printing distance is a distance required for forming the whole of the toner image to be formed with the set printing width. Next, the control portion 101 performs printing control while forming a toner belt on the long paper sheet P (step S108), and the control is finished.

The description goes back to the determination process of step S106. In the case where the instruction to perform successive printing is not obtained (step S106: NO), the control portion 101 displays, on the display portion 21, a screen prompting the user to select whether to stop printing control (hereinafter referred to as "stop printing"), and determines whether an instruction to stop printing is obtained from the user (step S109). In the case where it is determined that the instruction to stop printing is obtained (step S109: YES), the control portion 101 finishes the control. Meanwhile, in the case where the instruction to stop printing is not obtained (step S109: NO), the control portion 101 performs printing control involving the discharge sequence (step S110), and the control is finished.

The image forming apparatus 2 configured as described above can notify the user about the maximum printing distance corresponding to the coverage of the toner image that is the target of image formation. Moreover, as a result of the user setting an output printing distance based on the maximum printing distance, a plurality of toner images can be formed on the long paper sheet P without forcibly discharging a toner belt onto the long paper sheet P. Therefore, the printing region on the long paper sheet P can be used efficiently, and the wasteful consumption of the long paper sheet P can be suppressed.

In addition, changing the output printing distance is promoted in the case where the output printing distance is longer than the maximum printing distance, and thus the output printing distance that has been set once can be quickly changed to a distance equal to or shorter than the maximum printing distance.

In the case where the output printing distance is longer than the maximum printing distance, printing is stopped and the discharge sequence is performed, and thus printing control for a printing distance set by the user can be performed without wastefully consuming the long paper sheet P.

In the case were the output printing distance is longer than the maximum printing distance, the printing is stopped, and thus resetting the output printing distance set by the user can be facilitated.

Further, the maximum printing distance is recognized by the user before the output printing distance is set by the user, and thus setting a desired output printing distance can be facilitated.

Next, a first modification will be described. In the embodiment described above, the maximum printing distance is calculated by the control portion 101 before the output printing distance is set by the user. However, in the first modification, the control portion 101 calculates the maximum printing distance after the output printing distance is set by the user. In addition, in the case where the output printing distance set by the user is longer than the maximum printing distance, the control portion 101 causes the display portion 21 to display a screen promoting resetting of the output printing distance. According to this, the user can quickly reset the output printing distance after recognizing the maximum printing distance.

Figure 7:
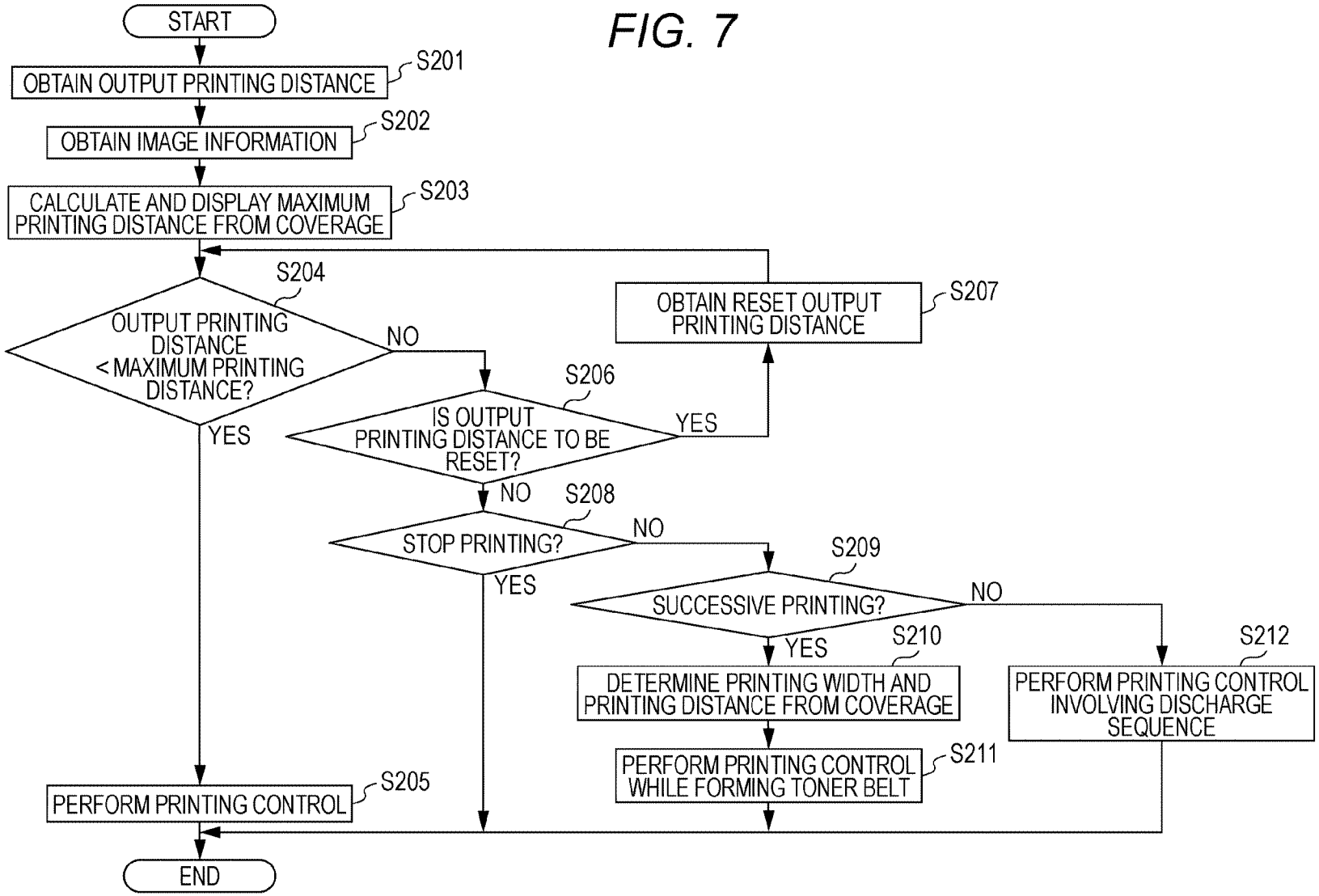
FIG. 7 is a flowchart illustrating an exemplary operation when performing printing control in an image forming apparatus according to a first modification.

Next, an exemplary operation when performing printing control in the image forming apparatus 2 including the control portion 101 according to the first modification will be described. FIG. 7 is a flowchart illustrating an exemplary operation when performing printing control in the image forming apparatus 2 according to the first modification. The process illustrated in FIG. 7 is performed when, for example, an instruction to perform the printing job is received.

As illustrated in FIG. 7, the control portion 101 obtains the output printing distance set by the user (step S201). Next, the control portion 101 obtains image information of the printing job (step S202). Next, the control portion 101 calculates the maximum printing distance with which successive printing can be performed from the coverage of the toner image in the image formation, and causes the display portion 21 to display the calculated maximum printing distance (step S203).

Next, the control portion 101 determines whether the output printing distance is shorter than the maximum printing distance (step S204). In the case where it is determined that the output printing distance is shorter than the maximum printing distance (step S204: YES), the control portion 101 performs printing control without forming a toner belt on the long paper sheet P (step S205), and the control is finished. Meanwhile, in the case where it is determined that the output printing distance is equal to or longer than the maximum printing distance (step S204: NO), the control portion 101 causes the display portion 21 to display a screen prompting the user to select whether to reset the output printing distance, and determines whether an instruction to reset the output printing distance is obtained from the user (step S206).

In the case where it is determined that the instruction to reset the output printing distance is obtained (step S206: YES), the control portion 101 obtains the reset output printing distance (step S207). Then, the process returns to step S204. Meanwhile, in the case where the instruction to reset the output printing distance is not obtained (step S206: NO), the control portion 101 determines whether the instruction to stop printing is obtained in a similar manner to the processing of step S109 of FIG. 6 (step S208).

In the case where it is determined that the instruction to stop printing is obtained (step S208: YES), the control portion 101 finishes the control. Meanwhile, in the case where the instruction to stop printing is not obtained (step S208: NO), the control portion 101 determines whether the instruction to perform successive printing is obtained in a similar manner to the processing of step S106 of FIG. 6 (step S209).

In the case where it is determined that the instruction to perform successive printing is obtained (step S209: YES), the control portion 101 sets a printing width and a printing distance from the coverage of the toner image (step S210). Next, the control portion 101 performs printing control while forming a toner belt on the long paper sheet P (step S211), and the control is finished.

The description goes back to the determination process of step S209. In the case where the instruction to perform successive printing is not obtained (step S209: NO), the control portion 101 performs printing control involving the discharge sequence (step S212), and the control is finished.

Next, a second modification will be described.

In the case of printing toner images of a plurality of colors on the long paper sheet P, it is often the case that the toner images are different from each other in the coverage thereof, and thus the maximum printing distance is different between the plurality of colors. For example, in the case where just the coverage of Y is extremely smaller than the other colors of Y, M, C, and K, if the output printing distance is set by matching the maximum printing distance with the other three colors, increase of the ratio of degraded toner in the developing device 412 of Y will be steeper than the other three colors. This leads to image defects.

To address this, in the case where the output printing distance set by the user is longer than the maximum printing distance, the control portion 101 according to the second modification calculates a difference between first coverage of each color and second coverage. The first coverage is coverage of the target of image formation, and the second coverage is coverage of a toner image of a color the maximum printing distance of which is shorter than the output printing distance among the plurality of colors. The control portion 101 causes the display portion 21 to display a screen notifying the difference between the first coverage and the second coverage. As a result of the difference between the first coverage and the second coverage being displayed in this way, the user can be notified about a toner image of which color among the plurality of colors has coverage insufficient for the set output printing distance.

In addition, the control portion 101 may control the image forming portion 40 so as to form a toner image corresponding to the difference between the first coverage and the second coverage on the long paper sheet P. The toner image corresponding to the first coverage and the second coverage may be formed, for example, as a toner belt on a side region of the long paper sheet P. Alternatively, the toner image corresponding to the difference between the first coverage and the second coverage may be formed as a toner image in a region in which the toner images G1 are not formed in FIG. 5, and, in the case where another printing job is present, the toner image may be formed as a toner image of a color in the other printing job coverage of which is insufficient in the region in which the toner images G1 are not formed.

Figure 8:
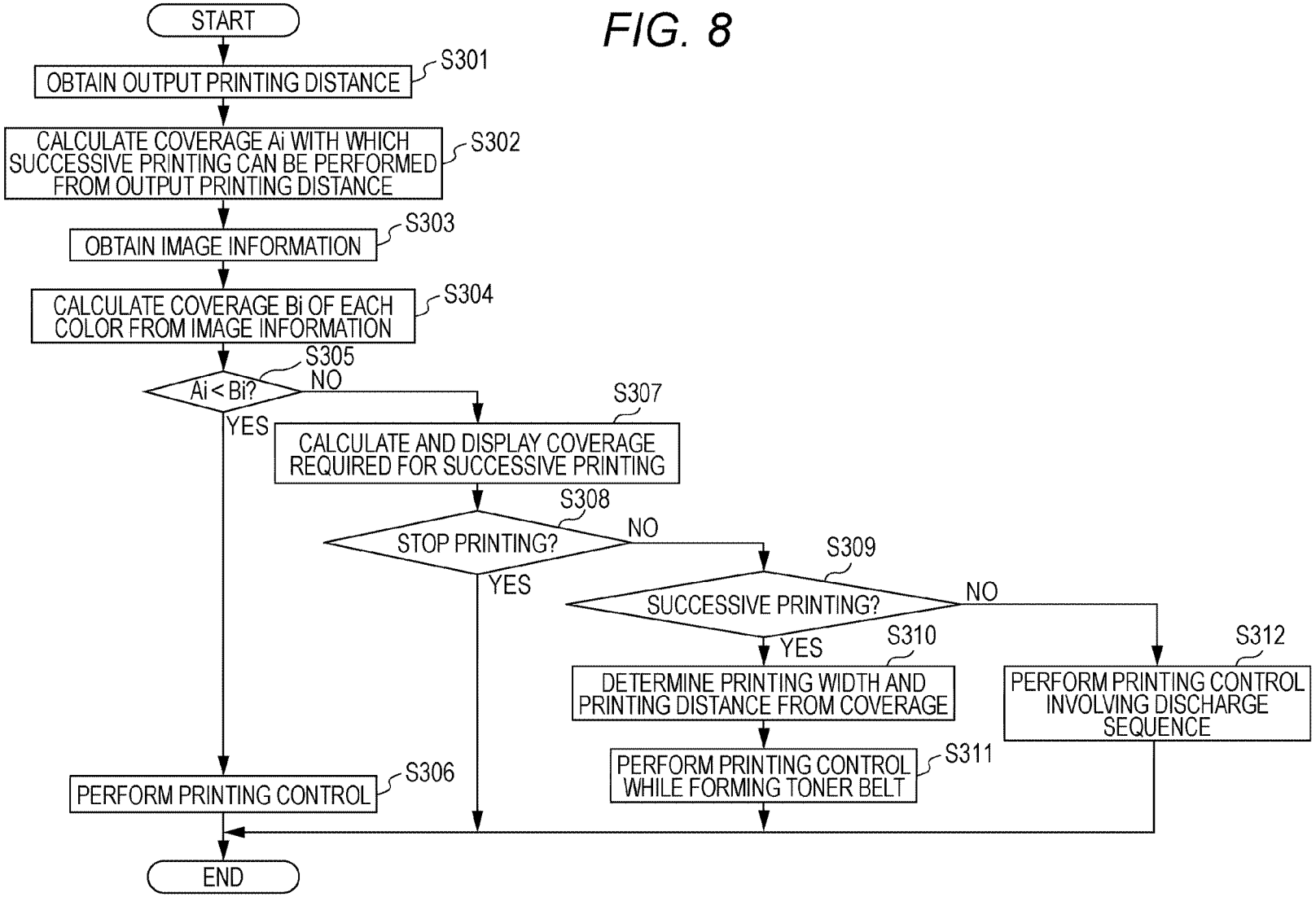
FIG. 8 is a flowchart illustrating an exemplary operation when performing printing control in an image forming apparatus according to a second modification.

Next, an exemplary operation when performing printing control in the image forming apparatus 2 including the control portion 101 according to the second modification will be described. FIG. 8 is a flowchart illustrating an exemplary operation when performing printing control in the image forming apparatus 2 according to the second modification. The process illustrated in FIG. 8 is performed when, for example, an instruction to perform the printing job is received.

As illustrated in FIG. 8, the control portion 101 obtains the output printing distance set by the user (step S301). Next, the control portion 101 calculates, for each color, coverage Ai corresponding to the second coverage with which successive image formation can be performed from the output printing distance (step S302). Next, the control portion 101 obtains image information of the printing job (step S303). Next, the control portion 101 calculates, for each of the plurality of colors, coverage Bi corresponding to the first coverage of the target of image formation from the image information (step S304).

Next, the control portion 101 determines whether the coverage Ai is smaller than the coverage Bi (step S305). In the case where it is determined that the coverage Ai is smaller than the coverage Bi (step S305: YES), the control portion 101 performs printing control without forcibly discharging a toner belt on the long paper sheet P (step S306), and the control is finished. Meanwhile, in the case where the coverage Ai is equal to or larger than the coverage Bi (step S305: NO), that is, where the second coverage is equal to or larger than the first coverage, the control portion 101 calculates coverage required for successive printing, that is, the difference between the first coverage and the second coverage, and causes the display portion 21 to display the calculated difference (step S307).

Next, the control portion 101 determines whether the instruction to stop printing is obtained in a similar manner to the processing of step S109 (step S308). In the case where it is determined that the instruction to stop printing is obtained (step S308: YES), the control portion 101 finishes the control. Meanwhile, in the case where the instruction to stop printing is not obtained (step S308: NO), the control portion 101 determines whether the instruction to perform successive printing is obtained in a similar manner to the processing of step S106 (step S309).

In the case where it is determined that the instruction to perform successive printing is obtained (step S309: YES), the control portion 101 sets a printing width and a printing distance from the coverage of the toner image (step S310). Next, the control portion 101 performs printing control while forming a toner belt on the long paper sheet P (step S311), and the control is finished.

The description goes back to the determination processing of step S309. In the case where the instruction to perform successive printing is not obtained (step S309: NO), the control portion 101 performs printing control involving the discharge sequence (step S312), and the control is finished.

Next, a third modification will be described.

In the embodiment described above, in the case where all printing control of one printing job is finished, control to refresh the toner in the developing device 412 by performing the discharge sequence is performed. However, in the case where the rate (hereinafter referred to as a "load rate") of the output printing distance to the maximum printing distance is relatively small in the printing job, the ratio of degraded toner in the developing device 412 is relatively small even after the printing job is finished because the output printing distance is small and thus the time for printing is short. Therefore, it is considered that there may be a case in which, depending on the load rate of the next printing job, image defects do not occur due to the increase of the ratio of degraded toner even without performing the discharge sequence.

Thus, in the third modification, the control portion 101 notifies, on the basis of the sum of load rates each set by the user for each of a plurality of printing jobs, the user about a combination of printing jobs that can be successively performed. In the case where there is a combination of printing jobs that can be successively performed in the plurality of printing jobs, the control portion 101 performs notification to prompt the user to change the order of the plurality of printing jobs such that the combination of printing jobs is performed successively. Further, in the case where a plurality of printing jobs are performed in combination, the control portion 101 does not perform the discharge sequence between the printing jobs. According to this, the discharge sequence is not performed wastefully, and thus the amount of consumption of toner can be reduced.

Here, an example of an idea about the load rate in the third modification will be described.

In the third modification, in the case where the coverage of the toner image is below a predetermined rate (3%) (hereinafter referred to as "low coverage") in the printing job, the load rate is calculated by output printing distance/maximum printing distance. By contrast, in the case where the coverage of the toner image is equal to or higher than the predetermined rate (hereinafter referred to as "high coverage") in the printing job, the developing device 412 is replenished with a sufficient amount of new toner. Thus, in the case where, for example, a second printing job of high coverage is performed after a first printing job of low coverage, the ratio of degraded toner in the developing device 412 is reduced by performing the second printing job compared with before the second printing job is performed. That is, it is considered that the load rate between a plurality of jobs is reduced by performing a printing job of high coverage. Considering this, in the third modification, it is considered that precise control cannot be performed if the load rate is calculated by output printing distance/maximum printing distance also in a printing job of high coverage because the load rate between a plurality of jobs increases in this case.

Therefore, in the control according to the third modification, the load rate is calculated so as to be equal to or lower than 0 in the case of a printing job of high coverage. More specifically, in the case of a printing job in which the coverage of the toner image is equal to the predetermined rate, the load rate is set to 0. In addition, in the case of a printing job in which the coverage of the toner image is larger than the predetermined rate, the load rate is calculated by output printing distance/maximum printing distance×(−1). According to this, the load rate between a plurality of jobs can be reduced by performing a printing job of high coverage.

Figure 9:
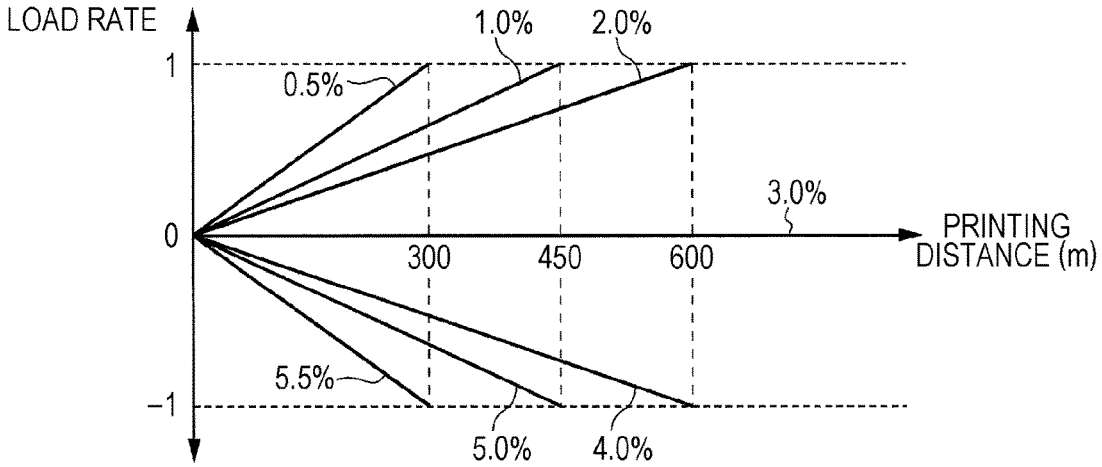
FIG. 9 illustrates a relationship between printing distance and load rate.

Next, an exemplary idea about the maximum printing distance will be described. FIG. 9 illustrates a relationship between printing distance and load rate.

In the case of a printing job of low coverage, the maximum printing distance is set to a printing distance that is generally recognized. For example, as illustrated in FIG. 9, the maximum printing distance is 300 m in the case where the coverage of the toner image is 0.5%, 450 m in the case where the coverage of the toner image is 1.0%, and 600 m in the case where the coverage of the toner image is 2.0%. By contrast, in the case of a printing job of high coverage, the maximum printing distance is larger than in a printing job of low coverage (see FIG. 4). Therefore, in the case of a printing job of high coverage, the absolute value of the load rate will become too small if the maximum printing distance is set to a distance that is generally recognized. In the case where the absolute value of the load rate is small in a printing job of high coverage, the sum of the load rate is reduced only slightly. However, practically, it is confirmed that the ratio of degraded toner in the developing device 412 is sufficiently reduced by replenishing the developing device 412 with new toner in a printing job of high coverage performed next after a printing job of low coverage.

Therefore, in the third modification, the maximum printing distance in a printing job of high coverage is set to a distance shorter than a distance that is generally recognized. The maximum printing distance of a printing job of high coverage is set for each coverage in accordance with, for example, the amount of new toner that is replenished. For example, the maximum printing distance is set to 600 m in the case where the coverage of the toner image is 4.0%, 450 m in the case where the coverage of the toner image is 5.0%, and 300 m in the case where the coverage of the toner image is 5.5%. It is considered that the reason why the maximum printing distance becomes smaller as the coverage increases is because the amount of replenished toner increases, that is, the ratio of degraded toner in the developing device 412 decreases, as the coverage increases, and thus the absolute value of the load rate increases in accordance with the increase or decrease. The maximum printing distance of a printing job of high coverage may be appropriately set in advance in accordance with an experiment or the like.

In addition, since the load rate is set to "0" in the case where the coverage of the toner image is 3.0% in the third embodiment, the maximum printing distance can be set to an arbitrary value such as "1000 m".

Further, since printing control can be performed to the maximum printing distance in one printing job, the control portion 101 selects a combination in which the load rate becomes "1" at most.

Next, a specific example in the third modification will be described.

Tables 1 to 3 show coverage, maximum printing distances, output printing distances, and load rates for each color in jobs 1 to 3.

TABLE 1

| Job 1 | Y | M | C | K |
|---|---|---|---|---|
| Coverage | 0.5 | 0.5 | 3 | 2 |
| Maximum printing distance | 300 | 300 | 1000 | 600 |
| Output printing distance | 200 | 200 | 200 | 200 |
| Load rate | 0.66 | 0.66 | 0 | 0.33 |

TABLE 2

| Job 2 | Y | M | C | K |
|---|---|---|---|---|
| Coverage | 1 | 2 | 0.5 | 0.5 |
| Maximum printing distance | 450 | 600 | 300 | 300 |
| Output printing distance | 150 | 150 | 150 | 150 |
| Load rate | 0.33 | 0.25 | 0.5 | 0.5 |

TABLE 3

| Job 3 | Y | M | C | K |
|---|---|---|---|---|
| Coverage | 0.5 | 5 | 1 | 4 |
| Maximum printing distance | 300 | 450 | 450 | 600 |
| Output printing distance | 150 | 150 | 150 | 150 |
| Load rate | 0.5 | −0.33 | 0.33 | −0.25 |

For example, in the case where jobs 1 to 3 of conditions shown in Tables 1 to 3 are on stand-by, the control portion 101 selects two jobs that can be combined from the jobs 1 to 3. Table 4 shows integrated load rates of combinations of two jobs for each color.

TABLE 4

| Integrated load rate | Y | M | C | K | Determination |
|---|---|---|---|---|---|
| Job 1 + Job 2 | 0.99 | 0.91 | 0.5 | 0.83 | o |
| Job 1 + Job 3 | 1.16 | 0.33 | 0.33 | 0.08 | x |
| Job 2 + Job 3 | 0.83 | −0.08 | 0.83 | 0.25 | o |

As shown in Table 4, in "job 1+job 2" that is a combination of the job 1 and the job 2 and "job 2+job 3" that is a combination of the job 2 and the job 3, the integrated load rates are below 1 for all colors of Y, M, C, and K. Therefore, in the present control, these combinations are determined as "o", and these combinations are selected. In addition, in "job 1+job 3" that is a combination of the job 1 and the job 3, the integrated load rate is more than 1 for Y. Thus, in the present control, the combination is determined as "x", and this combination is not selected.

In the embodiments described above, an output printing amount and a maximum printing amount have been exemplarily shown as printing distances of the long paper sheet P. However, the present invention is not limited to these embodiments. For example, the output printing amount and the maximum printing amount may be displayed in terms of the number of printed sheets. The number of printed sheets used herein represents the number of sheets in the case where a portion of the long paper sheet P the size of which corresponds to one cut paper sheet (for example, A3 size) is counted as one sheet.

In addition, the embodiments described above are merely specific examples of practical forms of the present invention, and the technical scope of the present invention should not be interpreted to be limited thereto. That is, the present invention can be implemented in various forms without deviating from the summary or the primary features thereof.

The present invention can be applied to an image forming system constituted by a plurality of units including an image forming apparatus. Examples of the plurality of units include external apparatuses such as a post-processing apparatus and a control apparatus connected via a network.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an image forming portion that includes a developing portion configured to discharge amounts of toner to an image bearing member bearing electrostatic latent images formed thereon to develop the electrostatic latent images as toner images, and is configured to form the toner images on a paper sheet for a print job, the print job defining coverage of the toner over the paper sheet, the toner images being transferred successively along an output printing distance on the paper sheet during the print job, the developing portion further configured to discharge an amount of the toner in addition to the amounts of the toner discharged for the toner images;

a notification portion configured to notify a user of a calculated toner image formation distance; and a control portion configured to use a relationship between coverage and toner image formation distance to calculate, in accordance with the coverage defined by the print job, a toner image formation distance, and configured to control the notification portion to notify the user of the calculated toner image formation distance, wherein the calculated toner image formation distance is a distance over which the toner images will be transferred successively onto the paper sheet without the developing portion discharging the amount of the toner in addition to the amounts of the toner discharged for the toner images.

2. The image forming apparatus according to claim 1, further comprising an operation portion, wherein the control portion receives the output printing distance from the user via the operation portion, and in response to the output printing distance being longer than the calculated toner image formation distance, the control portion controls the notification portion to perform notification so as to prompt the user to change the output printing distance via the operation portion.

3. The image forming apparatus according to claim 1, further comprising an operation portion, wherein the control portion receives the output printing distance from the user via the operation portion, and in response to the output printing distance being longer than the calculated toner image formation distance, the control portion controls the image forming portion to discharge during the print job, without forming the toner images on the paper sheet, the amount of toner from the developing portion in addition to the amounts of the toner discharged for the toner images.

4. The image forming apparatus according to claim 1, further comprising an operation portion, wherein the control portion receives the output printing distance from the user via the operation portion, and in response to the output distance being longer than the calculated toner image formation distance and the user not changing the output printing distance via the operation portion, the control portion controls the image forming portion to discharge, by forming a toner pattern on a part of the paper sheet during the print job, the amount of toner from the developing portion in addition to the amounts of the toner discharged for the toner images.

5. The image forming apparatus according to claim 1, further comprising an operation portion, wherein the control portion receives the output printing distance from the user via the operation portion, and in response to the output distance being longer than the calculated toner image formation distance, the control portion controls the image forming portion to stop performing the print job.

6. The image forming apparatus according to claim 1, further comprising an operation portion, wherein the control portion receives the output printing distance from the user via the operation portion, and in response to the output distance being longer than the calculated toner image formation distance, the control portion controls the notification portion to perform notification so as to prompt the user to select two or more of controlling the notification portion to perform notification so as to prompt the user to change the output printing distance via the operation portion of the image forming apparatus, controlling the image forming portion to discharge during the print job, without forming the toner images on the paper sheet, the amount of toner from the developing portion in addition to the amounts of the toner discharged for the toner images, controlling the image forming portion to discharge, by forming a toner pattern on a part of the paper sheet during the print job, the amount of toner from the developing portion in addition to the amounts of the toner discharged for the toner images, the amount being discharged in response to the user not changing the output printing distance via the operation portion of the image forming apparatus, and controlling the image forming portion to stop performing the print job.

7. The image forming apparatus according to claim 1, wherein the developing portion comprises a plurality of devices, each device configured to discharge toner of a color different from that of the other devices, the print job defining coverage of each of the toners of different colors, the developing portion further configured to discharge for each of the toners of different colors an amount of the toner in addition to the amounts of the toner discharged for the toner images;

wherein the control portion receives the output printing distance as a toner image formation distance from the user, and in response to the output printing distance being longer than the calculated image formation distance, the control portion calculates a difference between first coverage and second coverage for each of the colors and controls the notification portion to perform notification of information about a difference between the first coverage and the second coverage, the first coverage being coverage over the paper sheet by the toner of a respective color, the second coverage being coverage over the paper sheet by the toner of the respective color, the second coverage corresponding to a toner image formation distance, which is shorter than the output printing distance and is a distance over which the a toner image of the respective color will be transferred successively onto the paper sheet without the developing portion discharging, during the print job, the amount of the toner of the respective color in addition to the amounts of the toner of the respective color discharged for the toner images.

8. The image forming apparatus according to claim 1, further comprising an operation portion, wherein the control portion calculates the toner image formation distance before the output printing distance is set by the user via the operation portion.

9. The image forming apparatus according to claim 1, further comprising an operation portion, wherein the control portion calculates the toner image formation distance after the output printing distance is set by the user via the operation portion.

10. The image forming apparatus according to claim 1, wherein the control portion controls, on the basis of a sum of rates of output printing distances set by the user to calculated toner image formation distances of a plurality of printing jobs, the notification portion to notify the user about a combination of printing jobs that are capable of being performed successively.

11. The image forming apparatus according to claim 10, wherein, in a case where there is a combination of printing jobs that are capable of being successively performed in the plurality of printing jobs, the control portion controls the notification portion to perform notification to prompt the user to change an order of the plurality of printing jobs such that the combination of printing jobs is performed successively.

12. The image forming apparatus according to claim 1, wherein the control portion controls the image forming portion so as to discharge, after finishing the print job, the amount of toner from the developing portion in addition to the amounts of the toner discharged for the toner images.

13. An image forming system constituted by a plurality of units including an image forming apparatus, the image forming system comprising:

an image forming portion that includes a developing portion configured to discharge amounts of toner to an image bearing member bearing electrostatic latent images formed thereon to develop the electrostatic latent images as toner images, and is configured to form the toner images on a paper sheet for a print job, the print job defining coverage of the toner over the paper sheet, the toner images being transferred successively along an output printing distance on the paper sheet during the print job, the developing portion further configured to discharge an amount of the toner in addition to the amounts of the toner discharged for the toner images;

a notification portion configured to notify a user of a calculated toner image formation distance; and a control portion configured to use a relationship between coverage and toner image formation distance to calculate, in accordance with the coverage defined by the print job, a toner image formation distance, and configured to control the notification portion to notify the user of the calculated toner image formation distance, wherein the calculated toner image formation distance is a distance over which the toner images will be transferred successively onto the paper sheet without the developing portion discharging the amount of the toner in addition to the amounts of the toner discharged for the toner images.

14. A notification method of an image forming apparatus including an image forming portion that includes a developing portion configured to discharge amounts of toner to an image bearing member bearing electrostatic latent images formed thereon to develop the electrostatic latent images as toner images, and is configured to form the toner images on a paper sheet for a print job, the print job defining coverage of the toner over the paper sheet, the toner images being transferred successively along an output printing distance on the paper sheet during the print job, the developing portion further configured to discharge an amount of the toner in addition to the amounts of the toner discharged for the toner images, the notification method comprising:

using a relationship between coverage and toner image formation distance to calculate, in accordance with the coverage defined by the print job, a toner image formation distance, the calculated toner image formation distance being a distance over which the toner images will be transferred successively onto the paper sheet without the developing portion discharging the amount of the toner in addition to the amounts of the toner discharged for the toner images; and notifying a user about the calculated toner image formation distance.

* * * * *